US008492682B2

(12) United States Patent
Wang et al.

(10) Patent No.: US 8,492,682 B2
(45) Date of Patent: Jul. 23, 2013

(54) MICRO HEATER

(75) Inventors: Xue-Shen Wang, Beijing (CN); Qun-Qing Li, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 427 days.

(21) Appl. No.: 12/981,575

(22) Filed: Dec. 30, 2010

(65) Prior Publication Data

US 2012/0125915 A1 May 24, 2012

(30) Foreign Application Priority Data

Nov. 22, 2010 (CN) ..... 2010 1 0555629.4

(51) Int. Cl.
*H05B 3/10* (2006.01)
*H01C 3/14* (2006.01)

(52) U.S. Cl.
USPC ..... 219/553; 219/520; 219/538; 219/542; 219/443.1; 219/539; 219/544; 219/548; 219/541; 219/444.1; 338/306; 338/309; 338/322; 338/325; 338/331; 356/213; 356/223; 356/121; 356/122; 356/215; 977/742; 977/732; 977/833; 977/902; 977/954

(58) Field of Classification Search
USPC ..... 219/520, 438–9, 542–8, 443.1, 552–3, 219/541; 977/742, 732, 833–4, 902, 954; 338/306–9, 322–5, 331–2
See application file for complete search history.

(56) References Cited

U.S. PATENT DOCUMENTS

2010/0243637 A1 9/2010 Liu et al.
2011/0317155 A1 12/2011 Xiao et al.

FOREIGN PATENT DOCUMENTS

CN 101848564 9/2010
CN 101881659 11/2010

*Primary Examiner* — Shawntina Fuqua
(74) *Attorney, Agent, or Firm* — Altis Law Group, Inc.

(57) ABSTRACT

A micro heater includes a first electrode, a second electrode, a first carbon nanotube, and a second carbon nanotube. The first carbon nanotube extends from the first electrode. The second carbon nanotube branches from the second electrode. The first carbon nanotube and the second carbon nanotube intersect with each other to define a node therebetween.

20 Claims, 5 Drawing Sheets

MICRO HEATER

CROSS-REFERENCE TO RELATED APPLICATIONS

This application claims all benefits accruing under 35 U.S.C. §119 from China Patent Application No. 201010555629.4, filed on Nov. 23, 2010, in the China Intellectual Property Office, the disclosure of which is incorporated herein by reference.

BACKGROUND

1. Technical Field

The present disclosure relates to a heater, especially to a micro heater.

2. Description of Related Art

To increase a reaction speed and save cost of synthesizing a material, the material needs to be synthesized in a micro reactor. The micro-reactor includes a plurality of micro pipes. Each of the micro pipes includes a plurality of micro reaction tanks each having an area less than 10 square micrometers. If a reaction process of synthesizing the material includes a plurality of reaction steps, each of the reaction steps is accomplished in one micro reaction tank, and all of the reaction steps are accomplished in the micro reaction tank of one micro pipe. Generally, the micro reaction tanks should be heated by a typical heater, in the reaction process of synthesizing the material.

However, a heating area of the heater, such as a typical resistance wire, is generally far greater than the area of the micro reaction tank. For example, a heating area of the resistance wire is greater than 100 square micrometers. If one of the micro reaction tanks is heated by the heater, adjacent micro reaction tanks would be heated by the heater at the same time. Thus, reaction temperatures of the micro reaction tanks are hard to control.

What is needed, therefore, is to provide a micro heater, to overcome the above-described shortcoming.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings. It should be noted that references to "an" or "one" embodiment in this disclosure are not necessarily to the same embodiment, and such references mean at least one.

Figure 1:
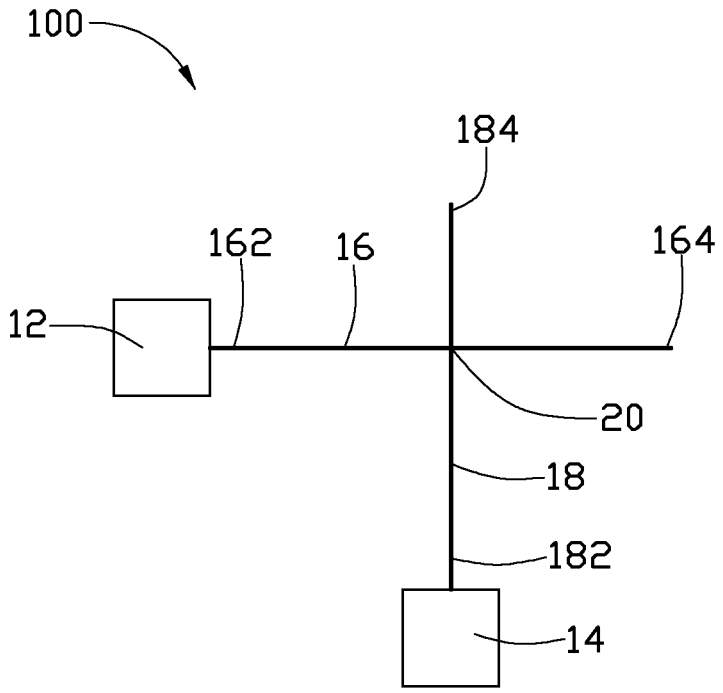
FIG. 1 shows a schematic structural view of an embodiment of a micro heater.

Referring to FIG. 1, a micro heater 100 of one embodiment is shown. The micro heater 100 includes a first electrode 12, a second electrode 14, a first carbon nanotube 16, and a second carbon nanotube 18. The first carbon nanotube 16 is electrically connected to the first electrode 12. The second carbon nanotube 18 is electrically connected to the second electrode 14 and intersects with the first carbon nanotube 16. Alternatively, the first carbon nanotube 16 and the second carbon nanotube 18 are crossed at a node 20.

The first electrode 12 and the second electrode 14 are made of conductive material. The conductive material can include conductive paste, metal, conductive metal-oxide, or carbon nanotube. The first electrode 12 and the second electrode 14 can have a free standing structure, or be a conductive film adhered to a substrate. In one embodiment, the first electrode 12 and the second electrode 14 are metal electrodes having a free standing structure.

Each of the first carbon nanotube 16 and the second carbon nanotube 18 is a single carbon nanotube. In one embodiment, the carbon nanotube is a conductive carbon nanotube. The carbon nanotube can be a single-wall carbon nanotube, a double-wall carbon nanotube, or a multi-wall carbon nanotube. A shape of the first carbon nanotube 16 or the second carbon nanotube 18 is not limited, provided two opposite ends of the first carbon nanotube 16 or the second carbon nanotube 18 are not connected with each other. For example, if an end of the first carbon nanotube 16 adjacent to the first electrode 12 is defined as a first connection end 162, an end of the first carbon nanotube 16 opposite to the first connection end 162 is defined as a first fixed end 164, and the first connection end 162 and the first fixed end 164 are not connected with each other. If an end of the second carbon nanotube 18 adjacent to the second electrode 14 is defined as a second connection end 182, an end of the second carbon nanotube 18 opposite to the second connection end 182 is defined as a second fixed end 184, and the second connection end 182 and the second fixed end 184 are not connected with each other. The shape of the first carbon nanotube 16 or the second carbon nanotube 18 can be linear shaped, curved shaped, or other shape. Simultaneously, if both of the first carbon nanotube 16 and the second carbon nanotube 18 are linear carbon nanotubes, only one node 20 can be defined between the first carbon nanotube 16 and the second carbon nanotube 18. If one of the first carbon nanotube 16 and the second carbon nanotube 18 is a curved carbon nanotube, two or more nodes 20 can be defined between the first carbon nanotube 16 and the second carbon nanotube 18.

The first carbon nanotube 16 is electrically connected to the first electrode 12 by the first connection end 162. In one embodiment, the first connection end 162 is fixed to the first electrode 12, or extends from the first electrode 12. The first fixed end 164 can be a free end or fixed to a support element. The second carbon nanotube 18 is electrically connected to the second electrode 14 by the second connection end 182. In one embodiment, the second connection end 182 is fixed to the second electrode 14, or extends from the second electrode 14. The second fixed end 184 can be a free end or fixed to a support element.

The first carbon nanotube 16 and the second carbon nanotube 18 intersect with each other to define the node 20 therebetween. Alternatively, an angle defined between a first extending direction of the first carbon nanotube 16 and a second extending direction of the second carbon nanotube 18 can be greater than 0 degrees and less than or equal to 90 degrees. Simultaneously, a resistance of the carbon nanotube along an extending direction thereof is greater than a resistance of any other direction. Thus, if the angle defined between the first extending direction and the second extending direction is greater than 0 degrees, a resistance of the node 20 can be far greater than a resistance of the first carbon nanotube 16 along the first extending direction, or a resistance of the second carbon nanotube 18 along the second extending direction. For example, if a length of the first carbon nanotube 16 is about 10 micrometers, the resistance of the first carbon nanotube 16 along the first extending direction can be less than 10 ohms, and if a length of the second carbon nanotube 18 is about 10 micrometers, the resistance of the second carbon nanotube 18 along the second extending direction can be less than 10 ohms. However, the resistance of the node 20 defined by the first carbon nanotube 16 and the second carbon nanotube 18 perpendicular to the first carbon nanotube 16 can be greater than or equal to about 1000 kilo-ohms The greater the angle, the greater the resistance of the node 20. In one embodiment, the angle is about 90 degrees, and the first carbon nanotube 16 is substantially perpendicular to the second carbon nanotube 18.

When the micro heater 100 is in operation, a heating signal can be transmitted to the first carbon nanotube 16, the second carbon nanotube 18, and the node 20 by the first electrode 12 and the second electrode 14. The heating signal can be an alternating electric signal, a direct electric signal, or other electric signals. The heating signal can substantially be converted into heat in the node 20, because the resistance of the node 20 is far greater than the resistance of the first carbon nanotube 16 or the second carbon nanotube 18. Therefore, a heating point can be formed in the node 20. The smaller the diameters of the first carbon nanotube 16 and the second carbon nanotube 18, the smaller the area of the node 20, and the smaller a heating area is defined by the micro heater 100. Generally, the diameters of the first carbon nanotube 16 and the second carbon nanotube 18 are from about 0.4 nanometers to about 50 nanometers, and as such, the area of the node 20 can be from about 0.16 square nanometers to about 2500 square nanometers. Therefore, the heating area of the micro heater 100 can be from about 0.16 square nanometers to about 2500 square nanometers. If the micro heater 100 is applied to heat micro reaction tanks of a micro reactor, only one micro reaction tank can be heated by the micro heater 100, because an area of the micro reaction tank is less than the heating area of the micro heater 100. Thus, reaction temperatures of the micro reaction tanks can be controlled easily and independently. The first carbon nanotube 16 and the second carbon nanotube 18 can also be defined as a heating element located between the first electrode 12 and the second electrode 14. The heating element can include the heating point defined by the first carbon nanotube 16 and the second carbon nanotube 18.

Figure 2:
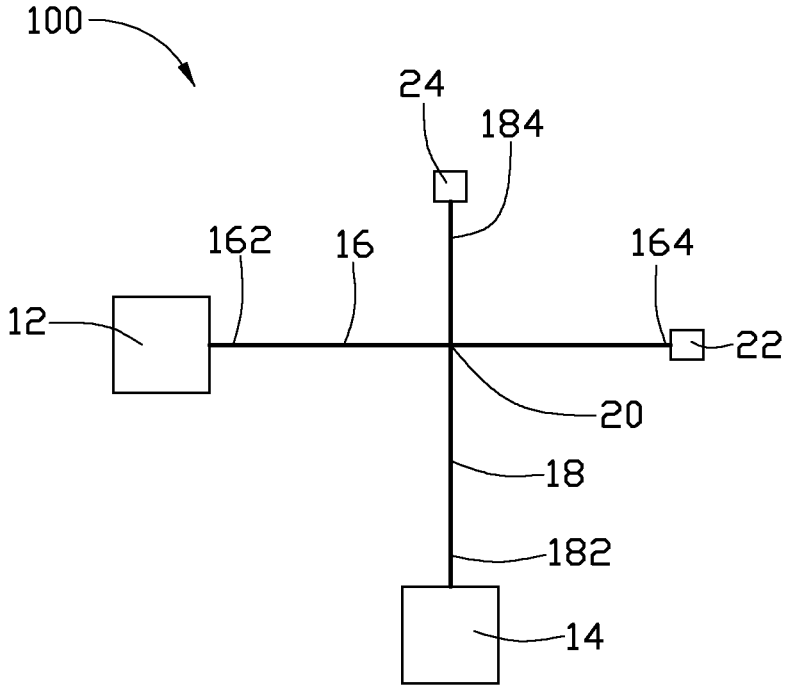
FIG. 2 shows a schematic structural view of an embodiment of another micro heater.

Referring to FIG. 2, a micro heater 100 of another embodiment is shown. The micro heater 100 further includes a first support element 22 and a second support element 24, to support the first carbon nanotube 16 and the second carbon nanotube 18. The first carbon nanotube 16 is fixed to the first support element 22 by the first fixed end 164. The second carbon nanotube 18 is fixed to the second support element 24 by the second fixed end 184.

The first support element 22 and the second support element 24 can have a rigid structure, thus, the free standing structures of the first electrode 12 and the second electrode 14 are not limited. For example, the first electrode 12 and the second electrode 14 can be silver paste not having a free standing structure. The silver paste can be printed on a substrate, such as a micro reaction tank. If the first electrode 12 has a free standing structure and the first carbon nanotube 16 can be supported by the first electrode 12 and the first support element 22, a portion of the carbon nanotube structure 16 not in contact with the first electrode 12 and the first support element 22 would be suspended between the first electrode 12 and the first support element 22. Simultaneously, if the second electrode 14 has a free standing structure and the second carbon nanotube 18 can be supported by the second electrode 14 and the second support element 24, a portion of the carbon nanotube structure 186 not in contact with the second electrode 14 and the second support element 24 would be suspended between the second electrode 14 and the second support element 24.

Figure 3:
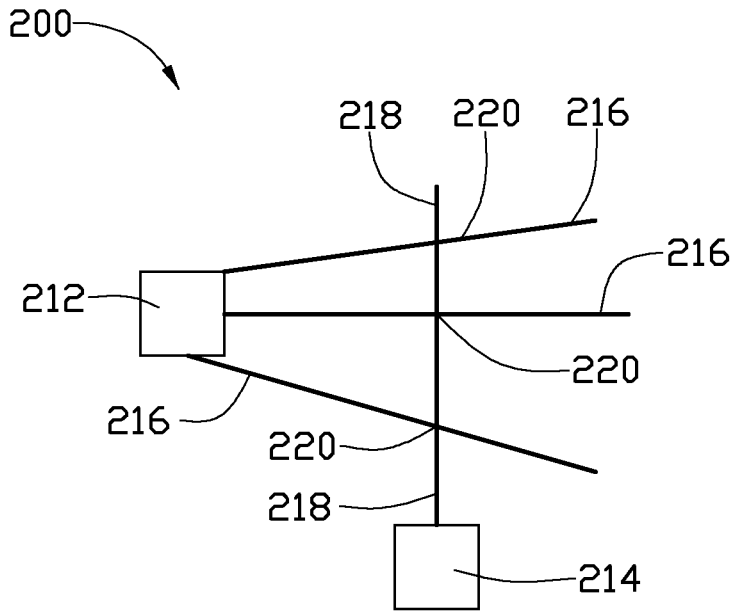
FIG. 3 shows a schematic structural view of an embodiment of a micro heater.

Referring to FIG. 3, a micro heater 200 of one embodiment is shown. The micro heater 200 includes a first electrode 212, a second electrode 214, a plurality of first carbon nanotubes 216, and a second carbon nanotube 218. The first carbon nanotubes 216 are electrically connected to the first electrode 212. The second carbon nanotube 218 is electrically connected to the second electrode 214 and intersects with the first carbon nanotubes 216. Alternatively, the first carbon nanotubes 216 and the second carbon nanotube 218 are crossed with each other to define a plurality of nodes 220 therebetween.

The compositions, features and functions of the micro heater 200 in the embodiment shown in FIG. 3 are similar to the micro heater 100 in the embodiment shown in FIG. 1, except that the micro heater 200 can include a plurality of first carbon nanotubes 216 and define a plurality of nodes 220.

The first carbon nanotubes 216 can extend from the first electrode 212 and intersect with the second electrode 214. Thus, the nodes 220 can be defined between the first electrode 212 and the second electrode 214. Therefore, if the micro heater 200 is in operation, a plurality of heating points can be defined in the micro heater 200. The heating points can work simultaneously when a heating signal is transmitted to the nodes 220 by the first electrode 212 and the second electrode 214.

If the micro heater 200 includes a plurality of first electrodes 212, and each of the carbon nanotubes 216 is electrically connected to one first electrode 212, the heating points can work at different times when a plurality of heating signals are transmitted to the nodes 220 at different times.

The micro heater 200 can further include a plurality of first support elements and a second support element to support the first carbon nanotubes 216 and the second carbon nanotube 218. The first carbon nanotubes 216 are fixed to the first support elements. The second carbon nanotube 218 is fixed to the second support element.

Figure 4:
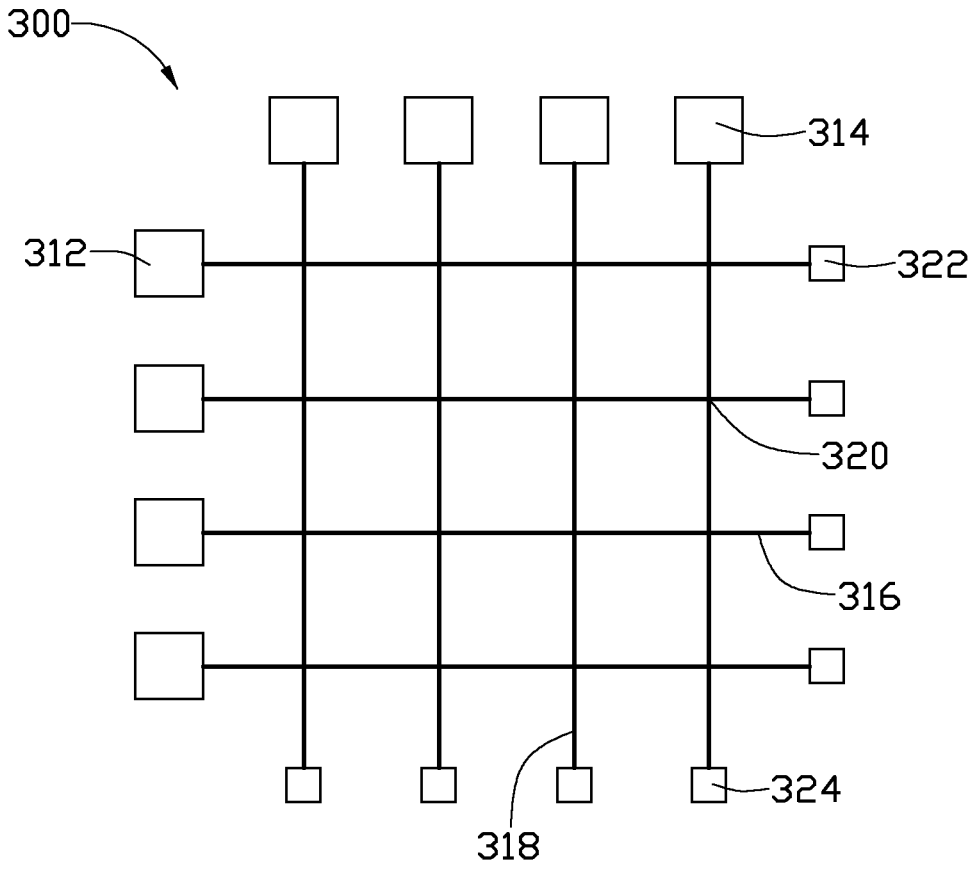
FIG. 4 shows a schematic structural view of an embodiment of a micro heater.

Referring to FIG. 4, a micro heater 300 of one embodiment is shown. The micro heater 300 includes a plurality of first electrodes 312, a plurality of second electrodes 314, a plurality of first carbon nanotubes 316, and a plurality of second carbon nanotubes 318.

The first carbon nanotubes 316 are electrically connected to the first electrodes 312 one to one. The first carbon nanotubes 316 are fixed to the first support elements 322 one to one. The second carbon nanotubes 318 are electrically connected to the second electrodes 314 one to one. The second carbon nanotubes 318 are fixed to the second support elements 324 one to one. Each of the first carbon nanotubes 316 intersects with all of the second carbon nanotubes 318. Each of the second carbon nanotubes 318 intersects with the first carbon nanotubes 316. Alternatively, the first carbon nanotubes 316 and the second carbon nanotubes 318 are crossed with each other to define a plurality of nodes 320 therebetween.

The compositions, features, and functions of the micro heater 300 in the embodiment shown in FIG. 4 are similar to the micro heater 100 in the embodiment shown in FIG. 1, except that the micro heater 300 can include a plurality of first electrodes 312, a plurality of second electrodes 314, a plurality of first carbon nanotubes 316, a plurality of second carbon nanotubes 318, and a plurality of nodes 320.

The first carbon nanotubes 316 can be linear carbon nanotubes substantially parallel to each other. A distance between adjacent first carbon nanotubes 316 is determined by a distance of adjacent heat micro reaction tanks of a micro reactor. Generally, the distance between adjacent first carbon nanotubes 316 can be greater than 100 nanometers. In one embodiment, the distance between adjacent first carbon nanotubes 316 can be from about 10 micrometers to about 1000 micrometers. The second carbon nanotubes 316 can be linear carbon nanotubes substantially parallel to each other. A distance between adjacent second carbon nanotubes 318 is determined by the distance of adjacent heat micro reaction tanks of the micro reactor. Generally, the distance between adjacent second carbon nanotubes 318 can be greater than 100 nanometers. In one embodiment, the distance between adjacent second carbon nanotubes 318 can be from about 10 micrometers to about 1000 micrometers. The second carbon nanotubes 318 can be substantially perpendicular to the first carbon nanotubes 316.

Figure 5:
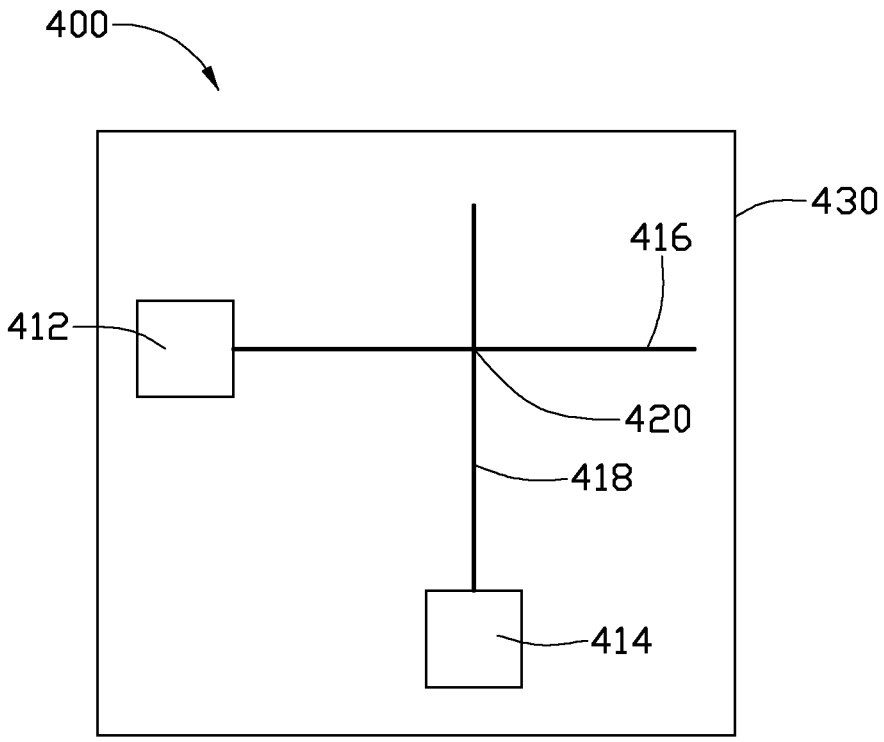
FIG. 5 shows a schematic structural view of an embodiment of a micro heater.

Referring to FIG. 5, a micro heater 400 of one embodiment is shown. The micro heater 400 includes a first electrode 412, a second electrode 414, a first carbon nanotube 416, a second carbon nanotube 418, and an insulating substrate 430. The first carbon nanotube 416 is electrically connected to the first electrode 412. The second carbon nanotube 418 is electrically connected to the second electrode 414 and intersects with the first carbon nanotube 416. Alternatively, the first carbon nanotube 416 and the second carbon nanotube 418 are crossed with each other to define a node 420 therebetween.

The compositions, features and functions of the micro heater 400 in the embodiment shown in FIG. 3 are similar to the micro heater 100 in the embodiment shown in FIG. 1, except that the micro heater 400 further includes the insulating substrate 430. The first electrode 412 and the second electrode 414 are located on a surface of the insulating substrate 430. The first carbon nanotube 416 and the second carbon nanotube 418 can be located on the surface of the insulating substrate 430, or suspended over the insulating substrate 430.

A shape and a structure of the insulating substrate 430 is not limited, provided the first electrode 412 and the second electrode 414 can be supported by the insulating substrate 430. The insulating substrate 430 can be a flexible substrate, or a rigid substrate. The insulating substrate 430 can be made of insulating material, or coated with the insulating material. A melting point or a transformation temperature of the insulating material can be greater than a reaction temperature of a reaction step reacted in the micro reactor. The insulating material can include glass, silicon, insulating plastic, and insulating ceramics. Simultaneous, the insulating substrate can be a micro reactor or micro reaction tanks of the micro reactor.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A micro heater, comprising:

a first electrode;

a second electrode;

a first carbon nanotube extending from the first electrode; and a second carbon nanotube branching from the second electrode;

wherein the first carbon nanotube and the second carbon nanotube are crossed with each other to define at least one node.

2. The micro heater of claim 1, wherein a shape of the first carbon nanotube is linear shaped or curved shaped, and a shape of the second carbon nanotube is linear shaped or curved shaped.

3. The micro heater of claim 2, wherein the shape of the first carbon nanotube is linear shaped, the shape of the second carbon nanotube is linear shaped, and an angle defined between the first extending direction of the first carbon nanotube and the second extending direction of the second carbon nanotube is greater than 0 degrees and less than or equal to 90 degrees.

4. The micro heater of claim 3, wherein the first extending direction is substantially perpendicular to the second extending direction.

5. The micro heater of claim 1, further comprising a plurality of first carbon nanotubes substantially parallel to each other, and a distance between adjacent first carbon nanotubes is greater than 100 nanometers.

6. The micro heater of claim 5, wherein the distance between adjacent first carbon nanotubes is from about 10 micrometers to about 1000 micrometers.

7. The micro heater of claim 1, further comprising a plurality of second carbon nanotubes substantially parallel to each other, and a distance between adjacent second carbon nanotubes being greater than 100 nanometers.

8. The micro heater of claim 7, wherein the distance between adjacent second carbon nanotubes is from about 10 micrometers to about 1000 micrometers.

9. The micro heater of claim 1, further comprising a plurality of first carbon nanotubes extending from the first electrode.

10. The micro heater of claim 1, further comprising a plurality of first carbon nanotubes and a plurality of first electrodes, and each of the first carbon nanotubes is electrically connected to one first electrode.

11. The micro heater of claim 1, further comprising a plurality of second carbon nanotubes extending from the second electrode.

12. The micro heater of claim 1, further comprising a plurality of second carbon nanotubes and a plurality of second electrodes, and each of the second carbon nanotubes is electrically connected to one second electrode.

13. The micro heater of claim 1, wherein an area of the at least one node is from about 0.16 square nanometers to about 2500 square nanometers.

14. The micro heater of claim 1, wherein a resistance of the at least one node is greater than or equal to 1000 kilo-ohms.

15. The micro heater of claim 1, further comprising an insulating substrate, and the first electrode and the second electrode are located on a surface of the insulating substrate.

16. A micro heater, comprising:

a first carbon nanotube comprising a first connection end and a first fixed end;

a second carbon nanotube comprising a second connection end and a second fixed end;

a first electrode electrically connected to the first connection end; and a second electrode electrically connected to the second connection end;

wherein the first carbon nanotube intersects with the second carbon nanotube to define a node therebetween.

17. The micro heater of claim 16, wherein the micro heater further comprises a first support element fixed to the first fixed end.

18. The micro heater of claim 16, wherein the micro heater further comprises a second support element fixed to the second fixed end.

19. A micro heater, comprising:

two electrodes; and a heating element comprising two carbon nanotubes crossed with each other to define a node therebetween.

20. The micro heater of claim 19, wherein a resistance of the node is greater than or equal to 1000 kilo-ohms.

* * * * *